US006183273B1

(12) United States Patent
Yu et al.

(10) Patent No.: US 6,183,273 B1
(45) Date of Patent: Feb. 6, 2001

(54) STACKED ELECTRICAL CARD CONNECTOR ASSEMBLY

(75) Inventors: Hung-Chi Yu, Hsi-Chih; Chun-Chi Tung, Tu-Chen, both of (TW)

(73) Assignee: Hon Hai Precision Ind. Co., Ltd., Taipei Hsien (TW)

( * ) Notice: Under 35 U.S.C. 154(b), the term of this patent shall be extended for 0 days.

(21) Appl. No.: 09/421,441

(22) Filed: Oct. 19, 1999

(30) Foreign Application Priority Data

Dec. 22, 1998 (TW) ..... 87221343

(51) Int. Cl.[7] ..... H01R 4/66
(52) U.S. Cl. ..... 439/92; 439/541.5
(58) Field of Search ..... 439/64, 92, 159, 439/607, 609, 541.5, 79

(56) References Cited

U.S. PATENT DOCUMENTS 5,364,275 * 11/1994 Ota et al. ..... 439/541.5
5,399,105 * 3/1995 Kaufman et al. ..... 439/609
5,775,923 * 7/1998 Tomioka ..... 439/541.5
5,967,803 * 10/1999 Ho ..... 439/541.5

* cited by examiner

*Primary Examiner*—Gary F. Paumen
(74) *Attorney, Agent, or Firm*—Wei Te Chung

(57) ABSTRACT

An electrical card connector assembly comprises top and bottom housing stacked together, four rows of contacts extending through the top and bottom housings, and top and bottom grounding plates respectively attached to the top and bottom housings. The top grounding plate includes a plurality of first contact strips adapted for grounding an electrical card, a pair of middle walls downwardly extending therefrom, a continuation portion perpendicularly extending from each middle wall. The bottom grounding plate connects with the top plate and includes a plurality of second contact strips adapted for grounding an electrical card and a plurality of fingers downwardly extending therefrom.

1 Claim, 7 Drawing Sheets

STACKED ELECTRICAL CARD CONNECTOR ASSEMBLY

BACKGROUND OF THE INVENTION

The present invention relates to an electrical card connector, and particularly to a stacked electrical card connector assembly having a pair of grounding plates securely attached thereto.

DESCRIPTION OF PRIOR ART

As the computer industry develops, higher quality signal transmission is desired, requiring better shielding. Thus, many electrical card connectors have grounding plates attached thereto for minimizing electromagnetic interference, as disclosed in Taiwan patent application No. 84112508 and U.S. Pat. No. 5,399,105.

Referring to FIG. 7, a conventional electrical card connector assembly 8 is mounted on a PCB 7 (printed circuit board) via a transition connector 85. The electrical card connector assembly 8 includes a pair of insulative bodies 80, four rows of contacts 81 retained in the insulative bodies 80, and a pair of grounding plates 82 attached to corresponding sides of the insulative bodies 80. A transition connector 85 is mounted on the PCB 7 with a pair of transition circuit boards 84 inserted thereinto. Each insulative body 80 includes a mating surface 802 and a mounting surface 804 opposite the mating surface 802. Each contact 81 includes a mating end 811 and a mounting end 812 opposite the mating end 811. The mating ends 811 extending beyond the mating surface 802 are adapted to engage with the terminals of an inserted electrical card (not shown). The mounting ends 812 extending beyond the mounting surface 804 are inserted into the circuit boards 84 and soldered thereto. Each grounding plate 82 includes a plurality of fingers 820 soldered to the circuit boards 84 and a plurality of tabs 822 stamped from a portion thereof opposite the fingers 820. The tabs 822 are adapted to contact corresponding grounding patterns of an inserted electrical card to eliminate static charges thereon.

However, to promote miniaturization, a height of the electrical card connector assembly 8 above the PCB 7 must be reduced.

SUMMARY OF THE INVENTION

Accordingly, an object of the present invention is to provide an electrical card connector assembly having stacked headers and grounding plates in a low profile configuration, thereby benefiting a reduced height of the connector assembly.

A second object of the present invention is to provide an electrical card connector assembly having excellent shielding capabilities.

In a preferred embodiment of the present invention, an electrical card connector assembly comprises top and bottom insulative housings stacked together, four rows of contacts extending through the top and bottom housings, a pair of top and bottom grounding plates respectively attached to the top and bottom housings, and an intermediate device attaching to the housings and holding mounting ends of the contacts in two rows. The top grounding plate includes a plurality of first contact strips adapted to contact a grounding pattern on an electrical card inserted opposite the top housing. A plurality of tails is formed on the top grounding strip opposite the first contact strips. The bottom grounding plate includes a plurality of second contact strips adapted to contact a grounding pattern on an electrical card inserted opposite the bottom housing. A plurality of downwardly extending fingers is formed on the bottom grounding strip opposite the second contact strips. The tails of the top plate electrically contact the bottom plate. An intermediate device is adapted to accept the contacts from the top and bottom housings as well as the fingers of the bottom grounding plate, while mechanically engaging with the top housing. The intermediate device is adapted to mate with a transition socket mounted on a PCB, electrically connecting the contacts and fingers with a set of terminals and grounding strip in the socket soldered to the PCB.

Other objects and advantages of the present invention will be understood from the following description of an electrical card connector assembly according to a preferred embodiment of the present invention shown in the accompanying drawings.

DETAILED DESCRIPTION OF THE PREFERRED EMBODIMENT

Figure 1:
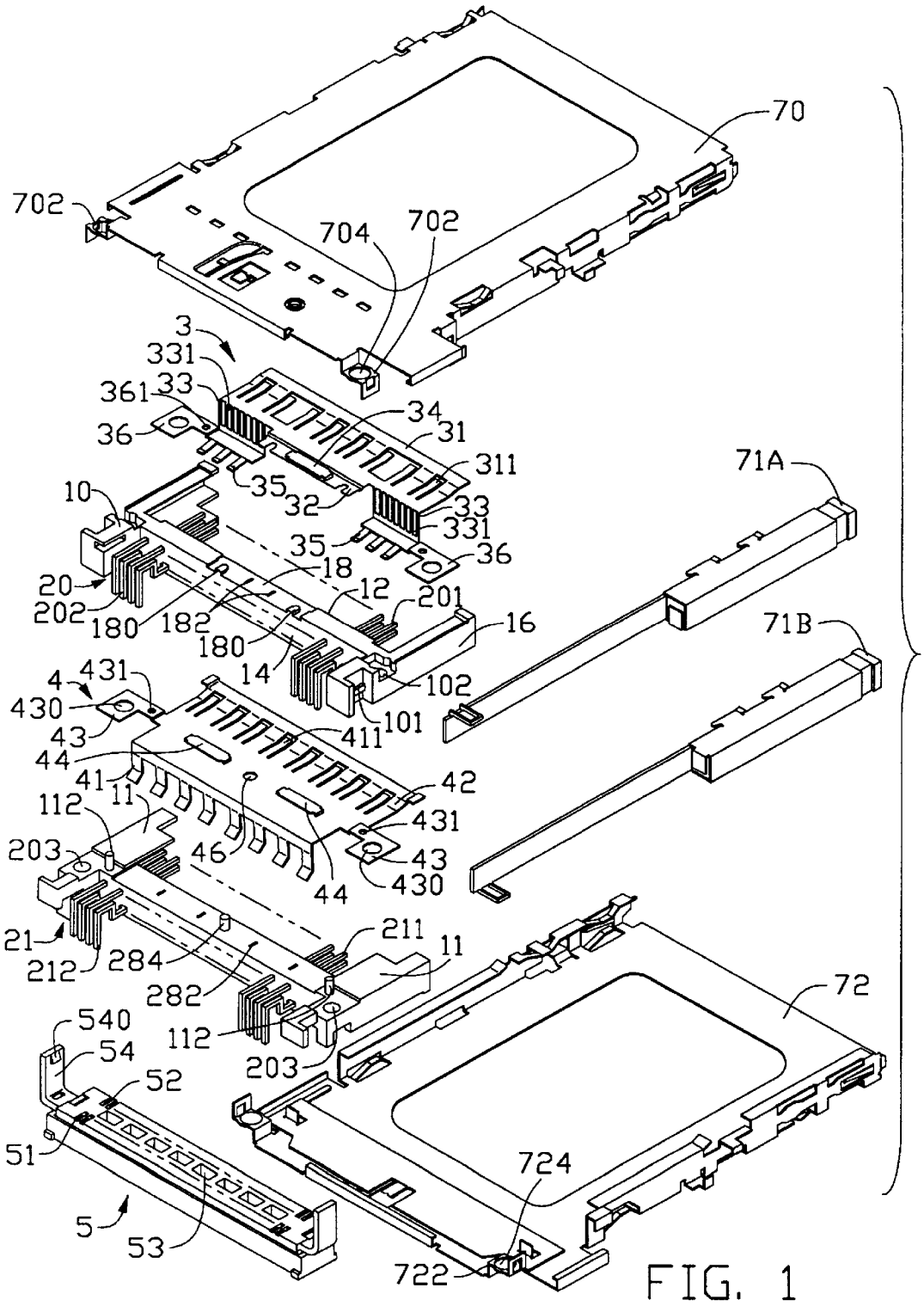
FIG. 1 is an exploded view of an electrical card connector assembly in accordance with the present invention.

Referring to FIG. 1, an electrical card connector assembly in accordance with the present invention comprises a pair of top and bottom insulative housings 10, 11 and a plurality of contacts 20, 21 retained therein, a pair of top and bottom grounding plates 3, 4 mounted thereto.

The top housing 10 includes a rear surface 12 and a front surface 14 opposite the rear surface 12. A pair of arms 16 rearwardly extends from opposite ends of the top housing 10 for guiding an inserted electrical card (not shown). In this embodiment, four rows of contacts are shown comprising two sets, a set of contacts 20 in the top housing 10 and a set of contacts 21 in the bottom housing 11. Each contact from each set of contacts 20, 21 includes a mating end 201, 211 and a mounting end 202, 212 opposite and perpendicular to the mating end 201, 211. Each set includes an upper row of L-shaped contacts and a lower row of contacts with a staggered structure relative to the L-shaped contact whereby the mounting ends 202, 212 of two rows of contacts in one set 20, 21 are in the same vertical plane.

The top housing 10 defines a recess 18 in a middle position of a top surface thereof. A pair of projections 180 is formed in the recess 18 proximate the front surface 14. A pair of elongate slits 182 is defined in the recess 18.

A pair of first holes 102 is defined proximate opposite ends of the top housing 10. A pair of ribs 101 is formed at the opposite ends of the top housing 10.

Figure 2:
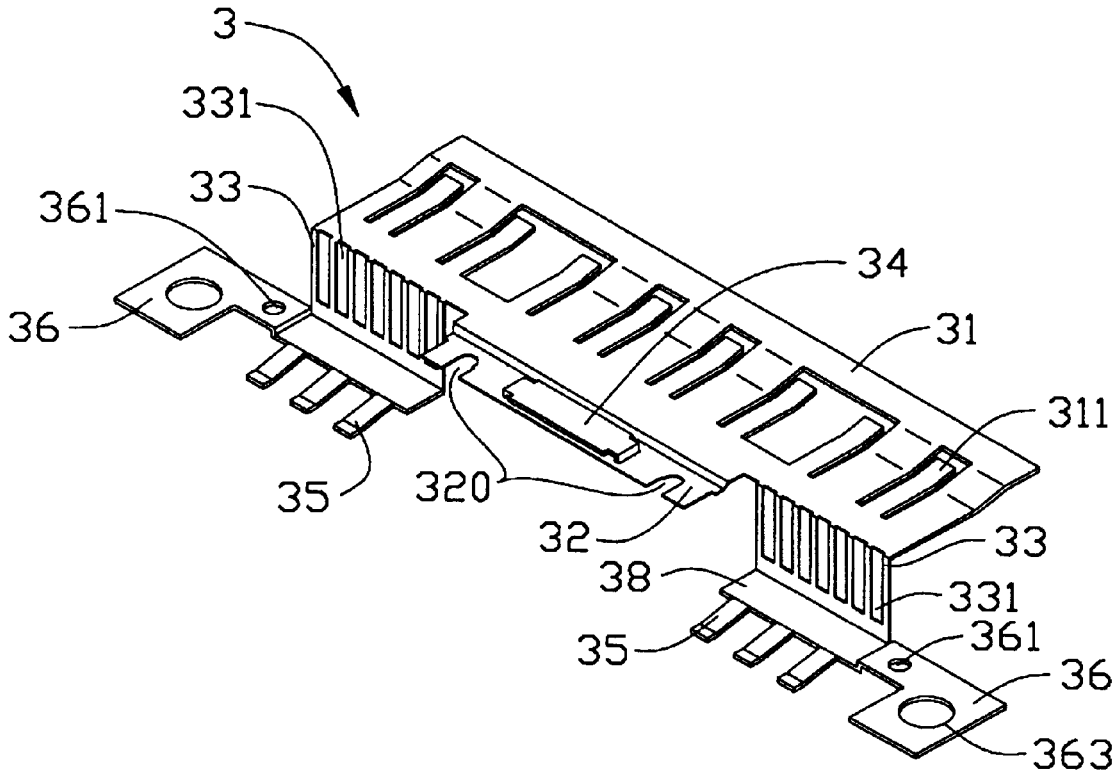
FIG. 2 is a perspective view of a top grounding plate of the present invention.

Also referring to FIG. 2, the top plate 3 includes an upwardly inclined rear edge 31 where a plurality of first contact strips 311 is stamped. A pair of middle walls 33 perpendicularly extends downward from a front edge of the top plate 3 proximate opposite lateral edges thereof with a plurality of elongate openings 331 defined therein. A fixing strip 32 extends from the front edge of the top plate 3 between the middle walls 33. A pair of notches 320 is defined in a front edge of the fixing strip 32 corresponding to the projections 180 of the top housing 10. A pair of first fixing slits (not shown) is defined in the fixing strip 32 in alignment with the elongate slits 182 of the top housing 10. A first fixing piece 34 has a pair of downwardly bent first latches (not shown) formed at opposite ends thereof. The first fixing piece 34 is attached to the fixing strip 32 with the first latches engaged in the first fixing slits.

A continuation portion 38 perpendicularly extends forward from each middle wall 33. A first positioning tab 36 laterally extends from each continuation portion 38 with a first opening 363 and a first aperture 361 defined therein. A plurality of tails 35 forwardly extends from a front edge of each continuation portion 38.

Figure 4:
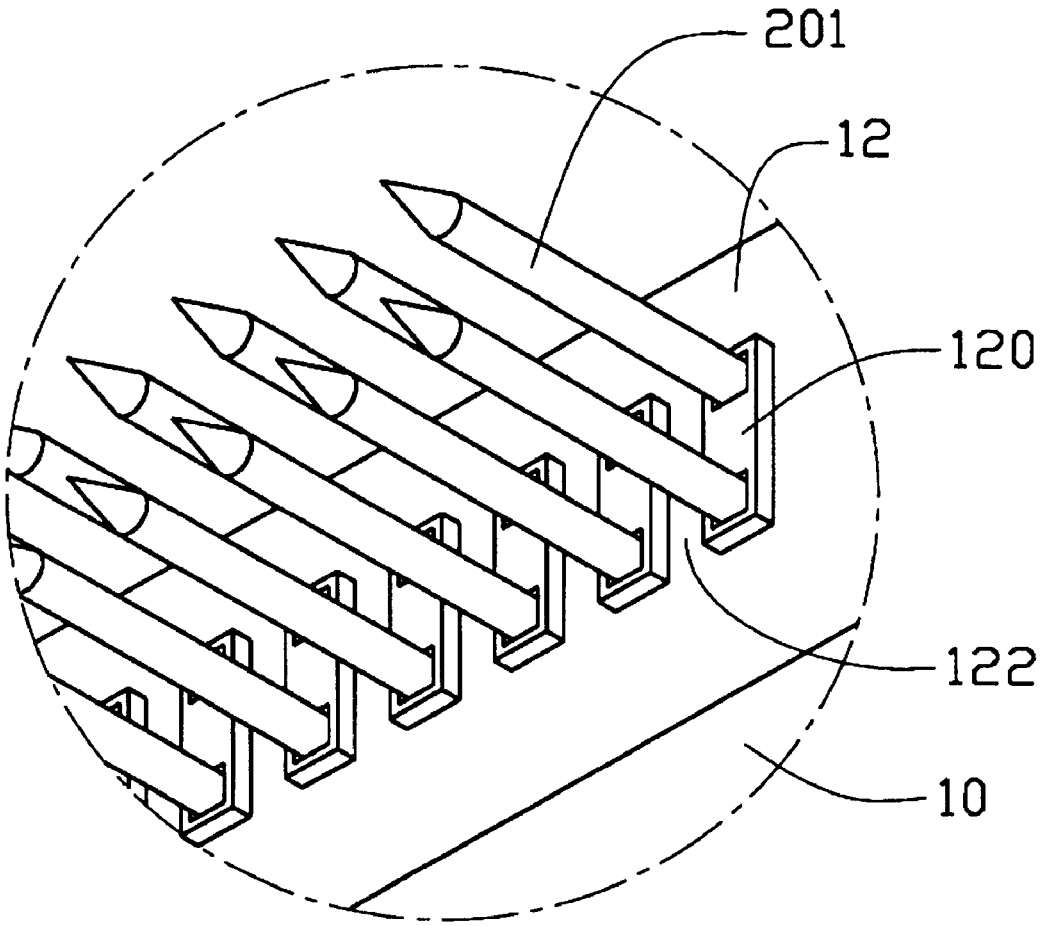
FIG. 4 is an enlarged view of a portion of a top housing of the present invention showing a plurality of protrusions formed on a rear surface thereof.

Also referring to FIG. 4, a plurality of protrusions 120 is formed around the mating ends 201 of the contacts 20 on the rear surface 12 of the top housing 10. A groove 122 is defined between each pair of proximate protrusions 120.

Figure 3:
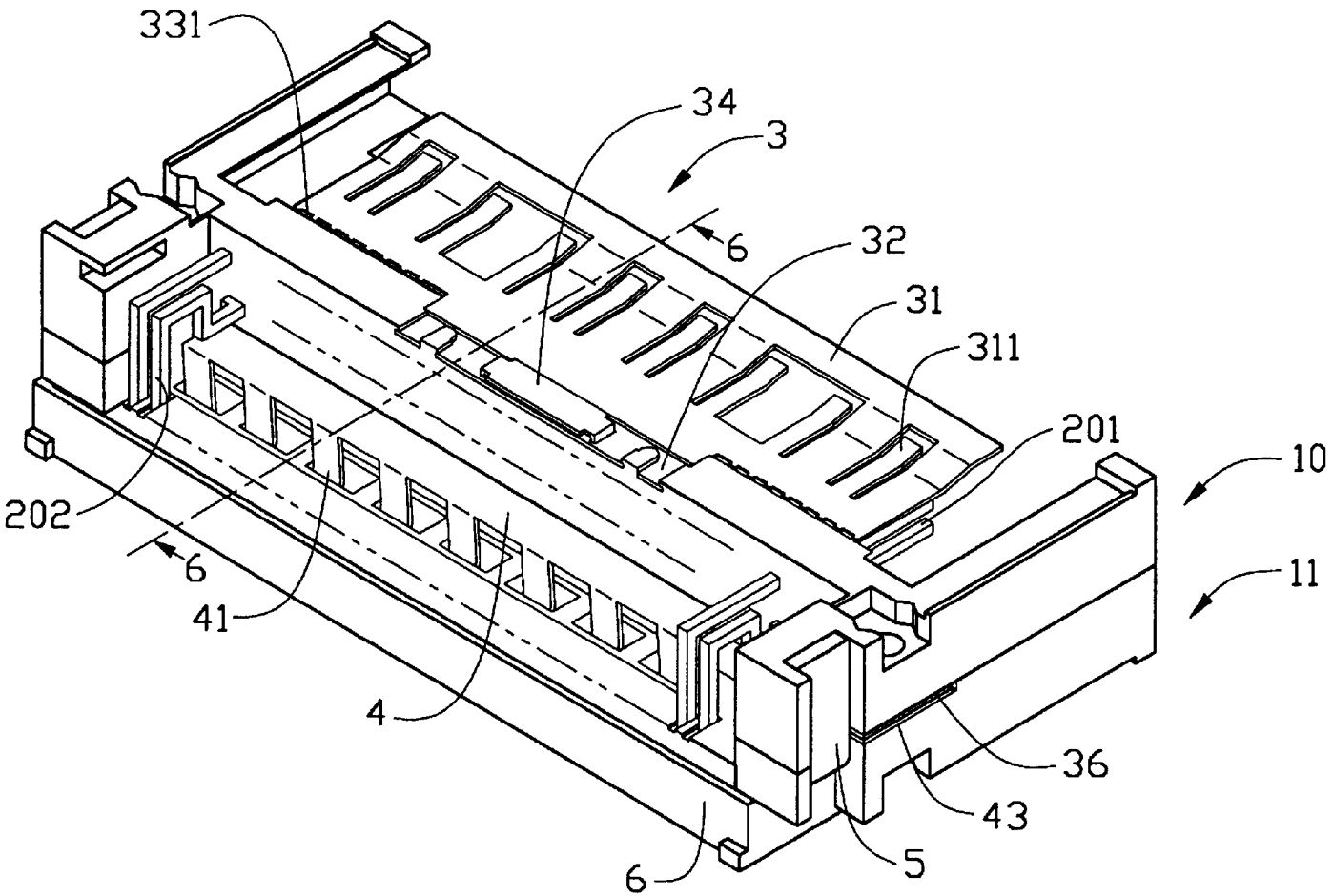
FIG. 3 is a partial and assembled view of FIG. 2.
Figure 5:
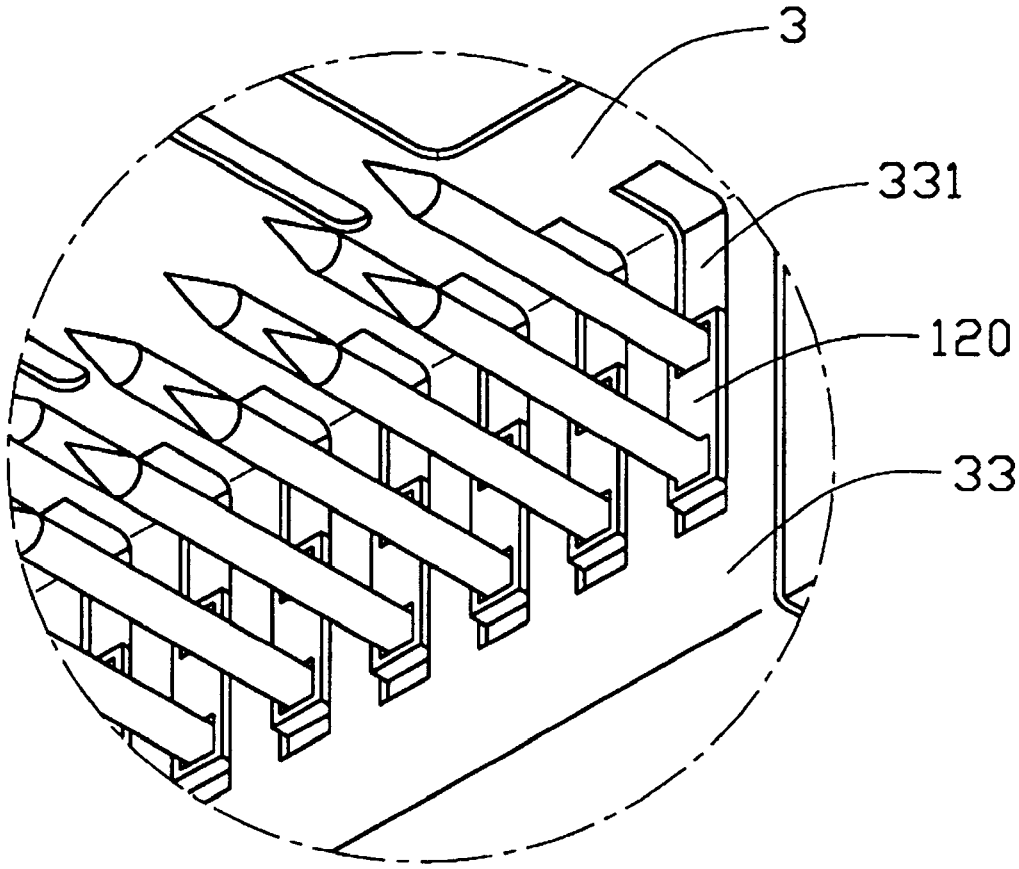
FIG. 5 is similar to FIG. 4 wherein a top grounding plate is assembled to the top housing.

Also referring to FIGS. 3 and 5, when the top plate 3 is assembled to the top housing 10, the middle walls 33 are attached to the rear surface 12 of the top housing 10. The protrusions 120 are engaged within the elongate openings 331 to ensure that a short circuit does not occur between the contacts 20 and the middle wall 33.

The fixing strip 32 rests within the recess 18 of the top housing 10 with the notches 320 engaging the projections 180 to prevent a forward movement of the top plate 3 relative to the top housing 10. The first fixing piece 34 secures the fixing strip 32 to the top housing 10 with the first latches extending through and engaging the elongate slits 182. The continuation portion 38 is attached to a bottom surface of the top housing 10 with the first openings 363 in alignment with the first holes 102.

When an electrical card is inserted into the electrical card connector assembly and engages with the contacts 20 retained in the top housing 10, the first contact strips 311 engage grounding patterns on the electrical card to eliminate static charges thereon.

The bottom housing 11 defines a pair of second holes 203 at opposite ends thereof. A pair of guiding posts 112 projects from a top surface of the bottom housing 11 proximate the second holes 203. Four elongate slits 282 are defined in the top surface of the bottom housing 11. A central pole 284 projects at a middle part of the top surface of the bottom housing 11.

The bottom plate 4 includes an upwardly inclined rear edge 42 and a plurality of second contact strips 411 stamped therein. A positioning hole 46 is defined in the bottom plate 4. Two second fixing pieces 44 attached to the bottom plate 4 include second latches (not shown) inserted in the second fixing slits (not shown) defined in the bottom plate 4. A pair of second positioning tabs 43 extends from opposite lateral edges of the bottom plate 4. A second opening 430 and a second aperture 431 are adapted to be in alignment with the first opening 363 and the first aperture 361, respectively. A plurality of fingers 41 perpendicularly extends downward from a front edge of the bottom plate 4.

When the bottom plate 4 is assembled between the top and the bottom housings 10, 11, the guiding posts 112 and the central pole 284 respectively extend through the first and second apertures 361, 431, and the positioning hole 46 to properly position the top and bottom plate 3, 4 between the top and the bottom housings 10, 11. The second openings 430 are aligned with the first openings 363.

When an electrical card is inserted into the electrical card connector assembly and engages with the contacts 21 retained in the bottom housing 11, the second contact strips 411 engage grounding patterns on the electrical card to eliminate static charges thereon.

Figure 6:
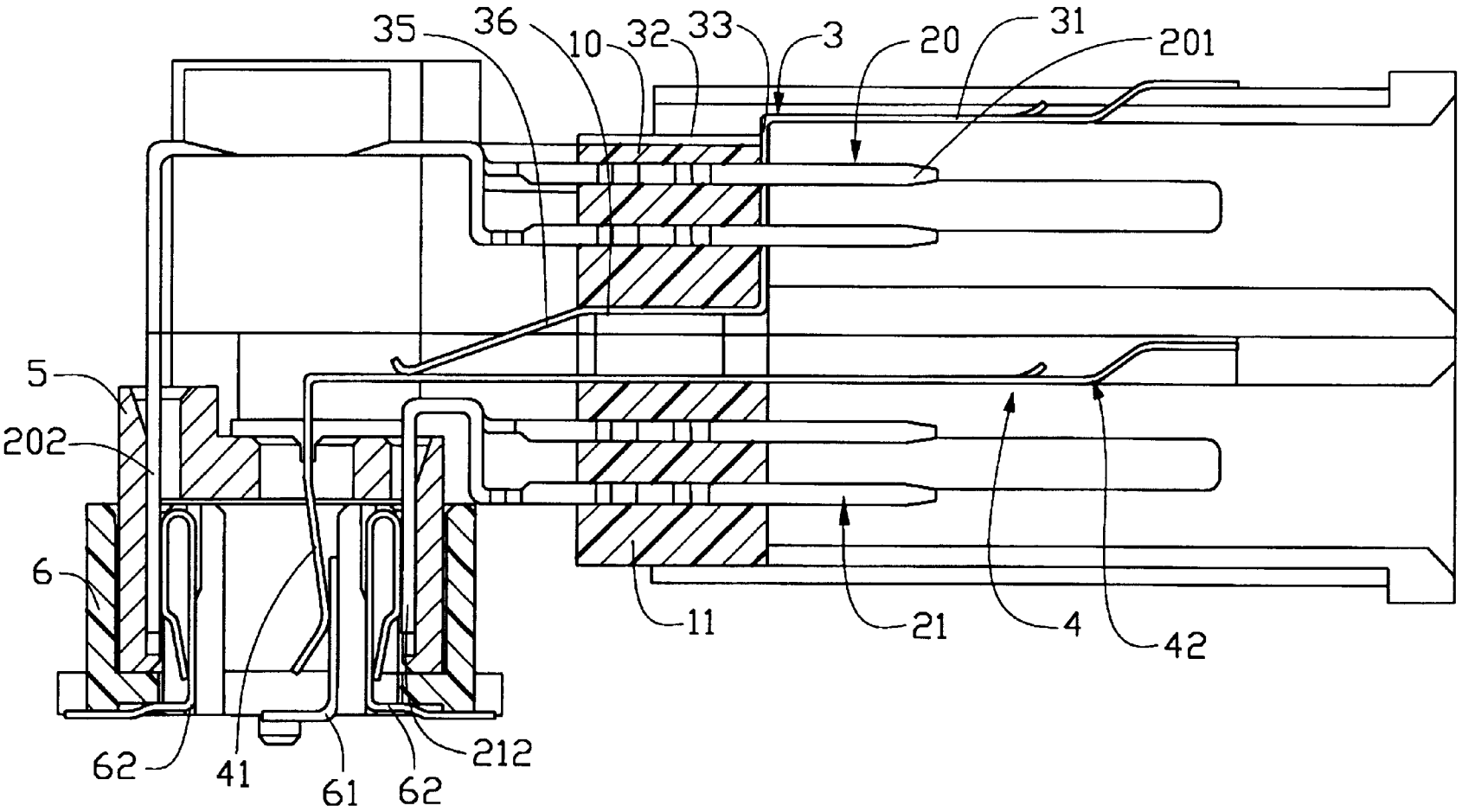
FIG. 6 is a cross-sectional view of an assembled electrical card connector assembly of the present invention viewed from line 6—6 of FIG. 3.
Figure 7:
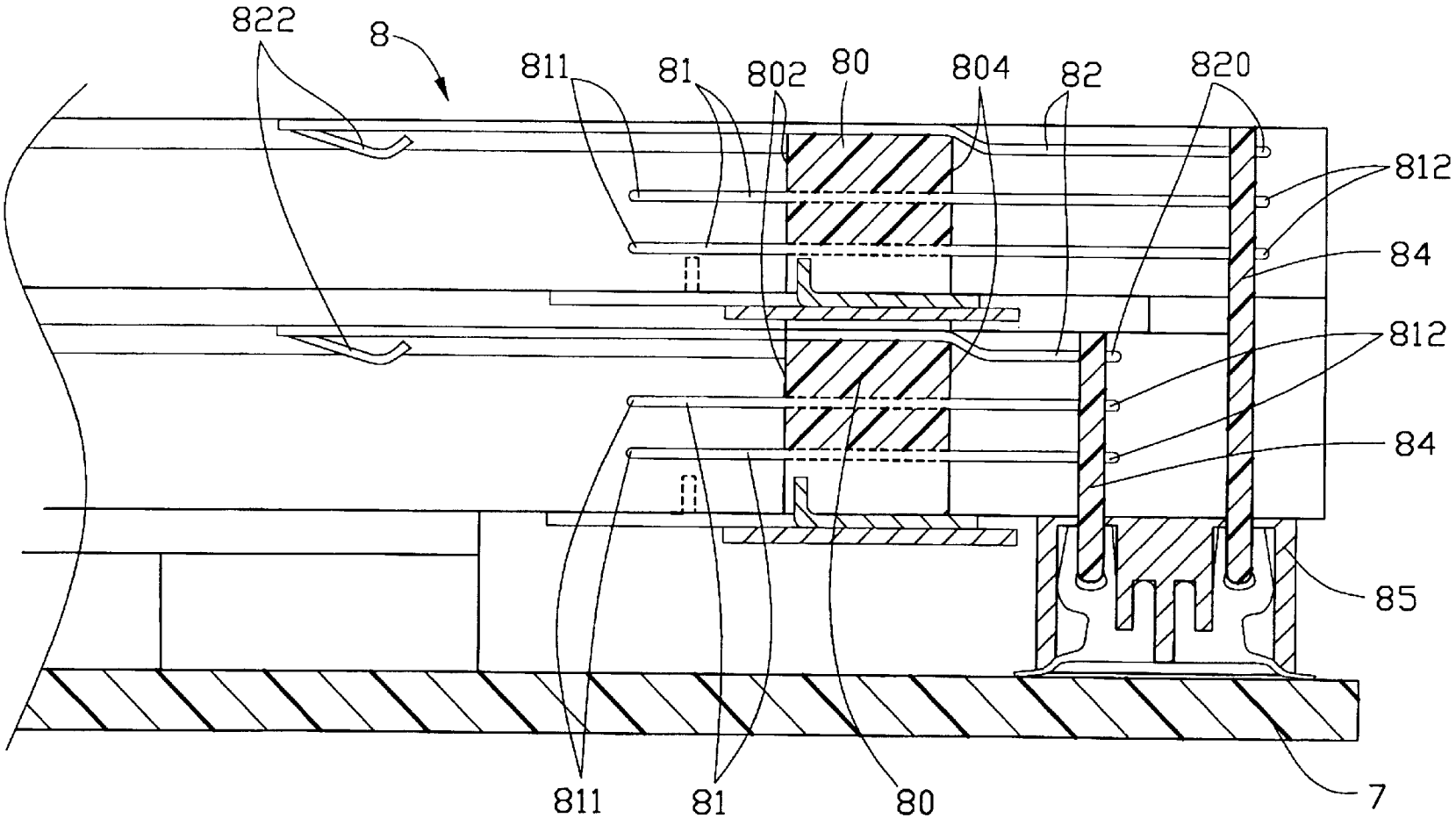
FIG. 7 (PRIOR ART)
FIG. 7 is a cross-sectional view of an assembled conventional electrical card connector assembly.

Also referring to FIG. 6, the fingers 41 of the bottom plate 4 are disposed between the two rows of the mounting ends 202, 212. The tails 35 of the top plate 3 rest on and electrically contact the bottom plate 4.

A top shielding cover 70 and a bottom shielding cover 72 are respectively attached to the top side of the top housing 10 and a bottom side of the bottom housing 11 to shield against external electromagnetic noise. A pair of ejection levers (not shown) is pivotally assembled to the top and the bottom shielding covers 70, 72. A pair of actuation levers 71A, 71B is respectively assembled to lateral edges of the top and bottom shielding covers 70, 72 and is pivotally connected to the ejection levers. The actuation levers 71A, 71B are adapted to be forwardly pushed, thereby pivoting the ejection levers and ejecting an inserted electrical card from the electrical card connector assembly. The top shielding cover 70 includes a pair of first fixing tabs 702 each with a first fixing hole 704 therethrough. The bottom shielding cover 72 includes a pair of second fixing tabs 722 each with a second fixing hole 724. The first and second fixing holes 704, 724 are in alignment with the first holes 102 and the second holes 203 of the top and bottom housings 10, 11 respectively, as well as with the first openings 363 and second openings 430 of the top plate 3 and the bottom plate 4, respectively.

A pair of fasteners (not shown) extends through the first fixing hole 704, the first hole 102, the first opening 363, the second opening 430, the second hole 203 and the second fixing hole 724 to secure the top shielding cover 70, the top housing 10, the top plate 3, the bottom plate 4, the bottom housing 11 and the bottom shielding cover 72 together.

Also referring to FIG. 6, the electrical card connector assembly further comprises an elongate intermediate device 5. The intermediate device 5 includes a pair of latches 54 upwardly extending from opposite ends thereof, two rows of first passageways 51, 52 longitudinally defined therein, a row of second passageways 53 longitudinally defined therein between the two rows of first passageways 51, 52. An inclined block 540 is formed on an inner side of the latches 54 corresponding to the ribs 101 of the top housing 10.

A transition socket 6 mounted on a PCB (Printed Circuit Board) (not shown) includes a plurality of terminals 62 each with a mounting portion perpendicularly extending therefrom and soldered to the PCB using Surface Mounting Technology, and a plurality of grounding strips 61 each with a mounting portion perpendicularly extending therefrom and soldered to the PCB using Surface Mounting Technology.

In assembly, the intermediate device 5 is secured to the top housing 10 with the inclined blocks 540 of the latches 54 engaging with the ribs 101. The two rows of mounting ends 202, 212 are inserted into the first passageways 51, 52. The fingers 41 are inserted into the second passageways 53. The intermediate device 5 then mates with the transition socket 6 with the mounting ends 202, 212 electrically engaging with the terminals 62 and the fingers 41 electrically engaging with the grounding strips 61.

The electrical card connector assembly of the present invention described above has a low structure thereby promoting component minimization.

It is understood that the invention may be embodied in other specific forms without departing from the spirit of the central characteristics thereof. Thus, the present examples and embodiments are to be considered in all respects as illustrative and not restrictive, and the invention is not to be limited to the details given herein.

What is claimed is:

1. An electrical card connector assembly mounted on a PCB, comprising:

first and second insulative housings stacked together;

rows of contacts extending through the first and second housings, respectively, each contact having a downwardly extending mating end;

a first grounding plate attached to the first housing and including a plurality of first contact strips adapted for contacting an inserted electrical card, and a plurality of spring fingers downwardly extending therefrom;

a second grounding plate attached to the second housing, the second grounding plate including a plurality of second contact strips formed at a rear edge thereof adapted for contacting an inserted electrical card, a downwardly extending middle wall, and a plurality of tails extending from the middle wall to electrically contact the first plate, the middle wall defining a plurality of elongate openings for extension of the contacts from the second housing;

an intermediate device movably assembled to the second housing, the intermediate device defining a first array of first passageways to receive the mating ends of the contacts and a second array of second passageways to receive the fingers of the first grounding plate; and a transition connector mounted on a PCB and including a plurality of terminals soldered to the PCB for engaging with the mating ends and a grounding strip soldered to the PCB for engaging with the spring fingers of the first grounding plate;

wherein a pair of ribs is formed at opposite longitudinal ends of the second housing and the intermediate device includes a pair of latches for movably engaging the ribs to assemble the intermediate device to the second housing;

wherein a second shielding cover and a first shielding cover are assembled to a second side of the second housing and a first side of the first housing;

wherein a plurality of protrusions is formed in the second housing and engages with the elongate openings of the second grounding plate to provide insulation between the middle wall of the second grounding plate and the contacts;

wherein a first hole is defined proximate one of longitudinal opposite ends of the second housing and a first opening is defined in the second grounding plate in alignment with the first hole, a fastener extending through the first hole and the first opening to secure the second housing and the second grounding plate together;

wherein a second hole is defined proximate one of longitudinal opposite ends of the first housing in alignment with the first hole of the second housing and a second opening is defined in the first grounding plate in alignment with the second hole, the fastener extending through the second hole and the second opening to secure the second housing, the second grounding plate, the first grounding plate and the first housing together.

* * * * *